US009532689B2

(12) United States Patent
Westbrook et al.

(10) Patent No.: US 9,532,689 B2
(45) Date of Patent: Jan. 3, 2017

(54) AIRFLOW INDICATOR ASSEMBLY AND METHOD FOR VACUUM CLEANER

(71) Applicant: SHOP VAC CORPORATION, Williamsport, PA (US)

(72) Inventors: Kurt Westbrook, Cogan Station, PA (US); Seth A. Bartley, Williamsport, PA (US); Kevin D. Fry, South Williamsport, PA (US)

(73) Assignee: SHOP VAC CORPORATION, Williamsport, PA (US)

( * ) Notice: Subject to any disclaimer, the term of this patent is extended or adjusted under 35 U.S.C. 154(b) by 428 days.

(21) Appl. No.: 14/253,238

(22) Filed: Apr. 15, 2014

(65) Prior Publication Data

US 2015/0289739 A1 Oct. 15, 2015

(51) Int. Cl.
*A47L 9/19* (2006.01)

(52) U.S. Cl.
CPC ..... *A47L 9/19* (2013.01)

(58) Field of Classification Search
CPC ..... A47L 9/19
USPC ..... 15/339
IPC ..... A47L 9/19
See application file for complete search history.

(56) References Cited

U.S. PATENT DOCUMENTS

| | | | |
|---|---|---|---|
| 3,934,543 | A | 1/1976 | Howard |
| 3,936,904 | A | 2/1976 | Bashark |
| 4,060,050 | A | 11/1977 | Simonsson |
| 4,153,003 | A | 5/1979 | Willis |
| 4,416,033 | A | 11/1983 | Specht |
| 4,419,782 | A | 12/1983 | Sobczyk et al. |
| 4,733,430 | A | 3/1988 | Westergren |
| 4,733,431 | A | 3/1988 | Martin |
| 5,325,707 | A | 7/1994 | Slater |
| 5,351,035 | A | 9/1994 | Chrisco |
| 5,668,535 | A | 9/1997 | Hendrix et al. |
| 5,778,486 | A | 7/1998 | Kim |
| 5,815,884 | A | 10/1998 | Imamura et al. |
| 5,961,677 | A | 10/1999 | Scott |
| 6,026,539 | A | 2/2000 | Mouw et al. |
| 6,029,309 | A | 2/2000 | Imamura |
| 6,110,260 | A | 8/2000 | Kubokawa |
| 6,192,548 | B1 | 2/2001 | Huffman |
| 6,446,302 | B1 | 9/2002 | Kasper et al. |
| 6,467,123 | B1 | 10/2002 | Di Nunzio et al. |
| 6,507,282 | B1 | 1/2003 | Sherwood |
| 6,836,930 | B2 | 1/2005 | Thur et al. |
| 6,910,245 | B2 | 6/2005 | Hawkins et al. |
| 6,993,985 | B2 | 2/2006 | Srebro |
| 7,210,194 | B2 | 5/2007 | Kiern |
| 7,287,301 | B2 | 10/2007 | Marshall et al. |
| 7,303,613 | B2 | 12/2007 | Rosenzweig |
| 7,373,689 | B2 | 5/2008 | Bowden et al. |
| 7,418,763 | B2 | 9/2008 | Shaver et al. |
| 7,470,360 | B2 | 12/2008 | Berry, III et al. |
| 7,475,712 | B2 | 1/2009 | McDowell |

(Continued)

FOREIGN PATENT DOCUMENTS

WO WO-2012/000991 A1 1/2012

*Primary Examiner* — David Redding
(74) *Attorney, Agent, or Firm* — Marshall, Gerstein & Borun LLP

(57) ABSTRACT

A vacuum cleaner having an airflow outlet and an airflow indicator assembly removably disposed at the outlet. The airflow indicator assembly includes a pair of fins attached to a spine and a needle disposed between the pair of fins. During operation of the vacuum cleaner, exhaust air is directed through the outlet and towards the needle, pushing the needle thereby indicating whether service is needed.

29 Claims, 8 Drawing Sheets

(56) References Cited

U.S. PATENT DOCUMENTS

| | | | |
|---|---|---|---|
| 7,713,339 | B2 | 5/2010 | Johansson |
| 7,740,707 | B2 | 6/2010 | Bertram et al. |
| 7,770,253 | B2 | 8/2010 | Ha et al. |
| 7,789,952 | B2 | 9/2010 | Tomasiak |
| 7,805,803 | B2 | 10/2010 | Andrup et al. |
| 8,250,703 | B2 | 8/2012 | Marshall et al. |
| 2004/0098823 | A1 | 5/2004 | Thur et al. |

AIRFLOW INDICATOR ASSEMBLY AND METHOD FOR VACUUM CLEANER

FIELD OF THE DISCLOSURE

The present disclosure relates generally to vacuum cleaners and, more specifically, to an airflow indicator for a vacuum cleaner.

BACKGROUND OF THE DISCLOSURE

Vacuum appliances, such as wet/dry vacuums are well known for use in collecting debris or other material. Conventional wet/dry vacuums typically include a tank mounted on wheels or casters, and a lid having a housing with a motor and impeller assembly attached thereto. The motor and impeller assembly create suction within the tank, which draws debris and/or liquid into the tank via an air inlet to which a flexible hose may be attached. A bag and/or filter within the tank typically prevents incoming debris from escaping, while allowing filtered air to pass to the impeller and escape through an exhaust outlet disposed on a portion of the tank or the lid, for example.

As debris or material collects on the bag or filter, however, the performance of the vacuum decreases. More specifically, small particles of dust or debris block the pores in the bag or filter and less air is able to pass through the bag or filter and, therefore, less air is pulled through the inlet and able to escape through the exhaust outlet. Thus, as the bag or filter becomes dirtier, the performance of the vacuum decreases.

Various indicators have been used in the past to measure the airflow characteristics or pressure within the vacuum cleaner as a way to gauge the airflow through the bag or filter and thus the need to change or clean it. Many of those indicators are expensive to manufacture and/or are subject to malfunction. As a result, there is a need for a low-cost, reliable device to determine whether there is a need to change or clean the bag or filter.

SUMMARY OF THE DISCLOSURE

In one example, a vacuum cleaner comprising an airflow outlet and an airflow indicator assembly removably disposed at the outlet is disclosed. The airflow indicator assembly includes a pair of fins attached to a spine, and a needle disposed between the pair of fins. During operation of the vacuum cleaner, exhaust air is directed through the outlet towards the needle, pushing the needle thereby indicating whether service is needed.

In another example, an airflow indicator assembly adapted to be disposed at an airflow outlet of a vacuum cleaner is disclosed. The airflow indicator assembly includes a spine, a pair of fins attached to the spine, and a needle disposed between the pair of fins. During operation of the vacuum cleaner, exhaust air is directed through the airflow outlet and towards the needle, pushing the needle thereby indicating whether service is needed.

In yet another example, a cap assembly for an airflow outlet of a vacuum cleaner is disclosed. The cap assembly includes a cap having a front end with at least one aperture and an airflow indicator assembly attached to the front end of the cap. The airflow indicator assembly includes a pair of fins attached to a spine, and a needle disposed between the pair of fins. During operation of the vacuum cleaner, exhaust air is directed through the airflow outlet towards the needle, pushing the needle indicating whether service is needed.

In yet another example, a method of manufacturing an airflow indicator assembly is disclosed. The method includes disposing a needle between a pair of fins attached to a spine and folding each fin of the pair of fins towards each other about at least one hinge disposed between the spine and at least one fin. The method further includes attaching the fins to each other via at least one attachment mechanism.

DETAILED DESCRIPTION OF THE DISCLOSURE

Figure 1:
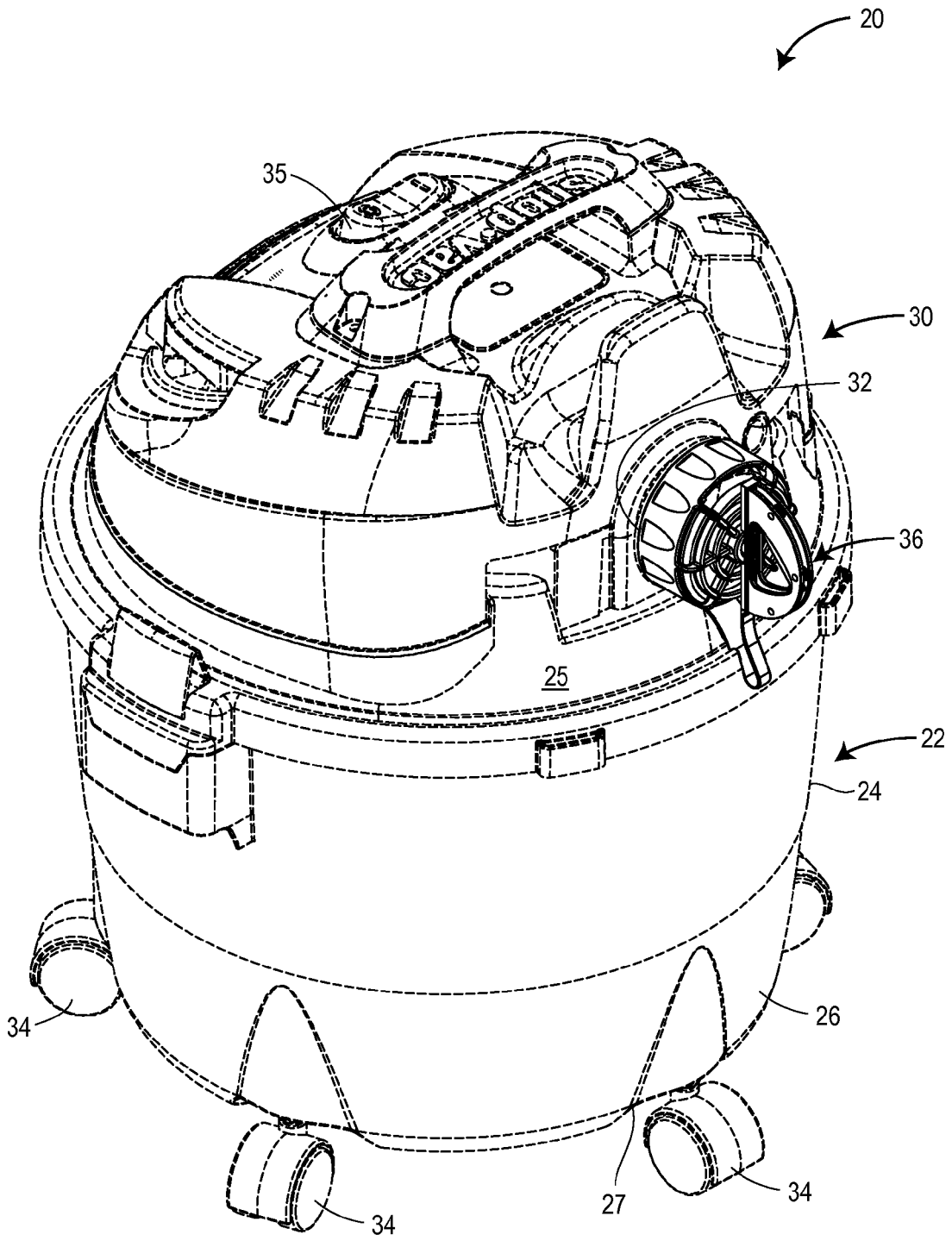
FIG. 1 is a rear perspective view of a vacuum cleaner with an airflow indicator assembly of the present disclosure.
Figure 2:
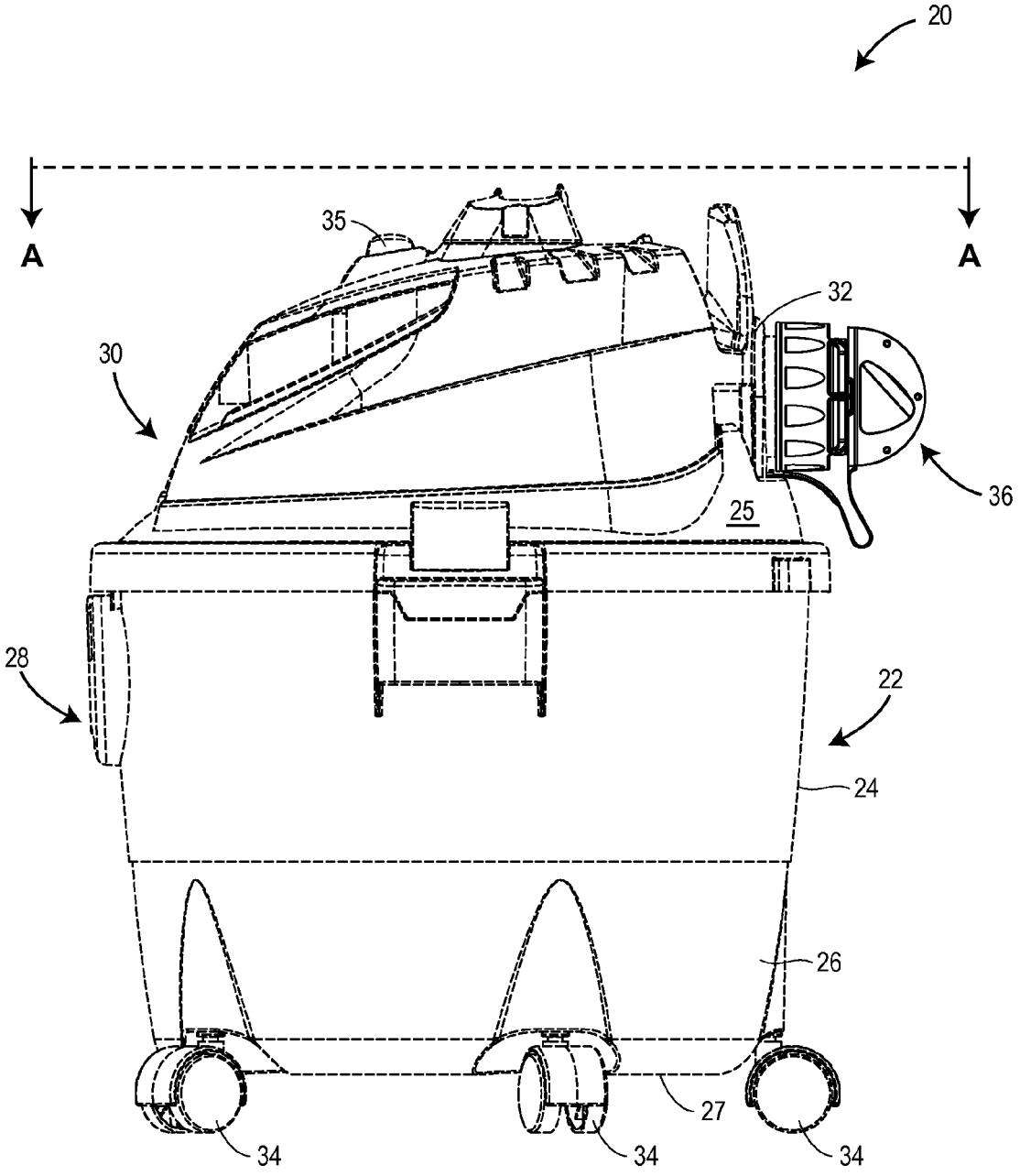
FIG. 2 is a side view of the vacuum cleaner with the airflow indicator assembly of the present disclosure.
Figure 3:
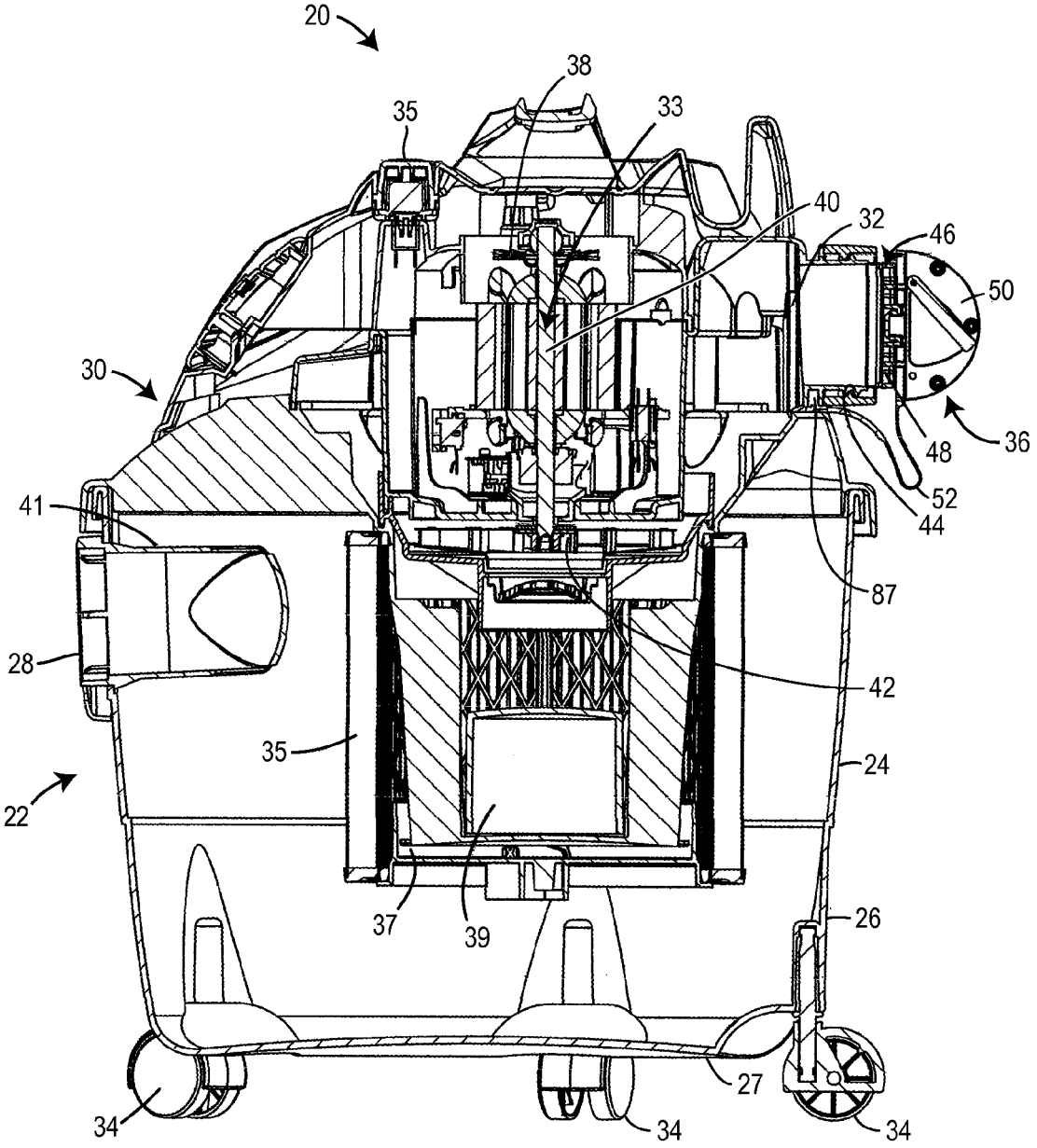
FIG. 3 is a side cross-sectional view of the vacuum cleaner with the airflow indicator assembly of the present disclosure taken along the lines A-A of FIG. 2.

Referring now to FIGS. 1-3, a vacuum cleaner 20 constructed in accordance with the teachings of the present disclosure is generally depicted. The vacuum cleaner 20 includes a tank 22 having a side wall 24 with an upper portion 25, a base 26 and a closed bottom 27. The tank 22 further includes an inlet 28 (FIG. 2) that is adapted to receive a hose (not shown). The tank 22 is enclosed by a removable lid assembly 30 that may include an outlet 32. The outlet 32 is adapted to receive a hose (not shown) like the inlet 28, enabling the hose to be used in both vacuuming and blowing capacities. More specifically, air drawn into the tank 22 through the inlet 28 may be directed through the outlet 32, e.g., the exhaust outlet 32. The lid assembly 30 houses a motor/impeller unit 33 (FIG. 3), which can be energized upon actuation of a switch 35. In addition, a plurality of casters 34 or other wheels may be attached to the tank 22 to facilitate movement of the vacuum cleaner about a worksite, for example.

In the present example, the tank 22 is generally cylindrical, the lid assembly 30 is correspondingly shaped, and both are manufactured from molded plastic. One of ordinary skill in the art will also appreciate that the tank 22 and lid assembly 30 may be alternatively shaped and manufactured from other materials and processes and still fall within the scope of the present disclosure.

As further illustrated in FIGS. 1 and 2, an airflow indicator assembly 36 according to the present disclosure is disposed at the outlet 32, as described in greater detail below. Generally, the airflow indicator assembly 36 provides an indication to a user of the vacuum cleaner 20 of whether air flow through the tank 22 is compromised based on the level of air flow through the outlet 32. In other words, if the air flow through the outlet 32 is reduced, service to the vacuum cleaner 20 is likely needed. Such service may include replacing a dirty or overused filter or vacuum bag or clearing a blockage in a hose, wand or accessory attached to the inlet 28, for example.

Referring now to FIG. 3, a cross-sectional view of the vacuum cleaner 20 taken along the line A-A of FIG. 2 is depicted. The motor/impeller unit 33 includes a motor 38 from which a rotatable shaft 40 extends. A vacuum impeller 42 is mounted to the shaft 40 for rotation within a vacuum chamber for generation of a low pressure area within the tank 22 for vacuuming purposes. A filter 35 may be attached to a lid cage 37 housing a float 39. The impeller 42 draws air through the filter 35, which removes particulate and other material from the air before it passes to the impeller 42. A vacuum bag (not shown) may be attached to an inlet fitting 41, so that material entering the inlet 28 is contained within the bag. The vacuum cleaner 20 can be used to vacuum wet materials, in which case a bag is generally not used with the tank 22, and wet material gathered by the vacuum cleaner 20 is deposited directly within the tank 22. When vacuuming dry material the vacuum cleaner 20 may be used with a bag, a filter or with both. Bags and filters are generally made of porous material such as a paper or various types of cloth and may become clogged with dirt and dust as they are used, thereby reducing airflow through the vacuum cleaner 20 and reducing its performance.

Figure 4:
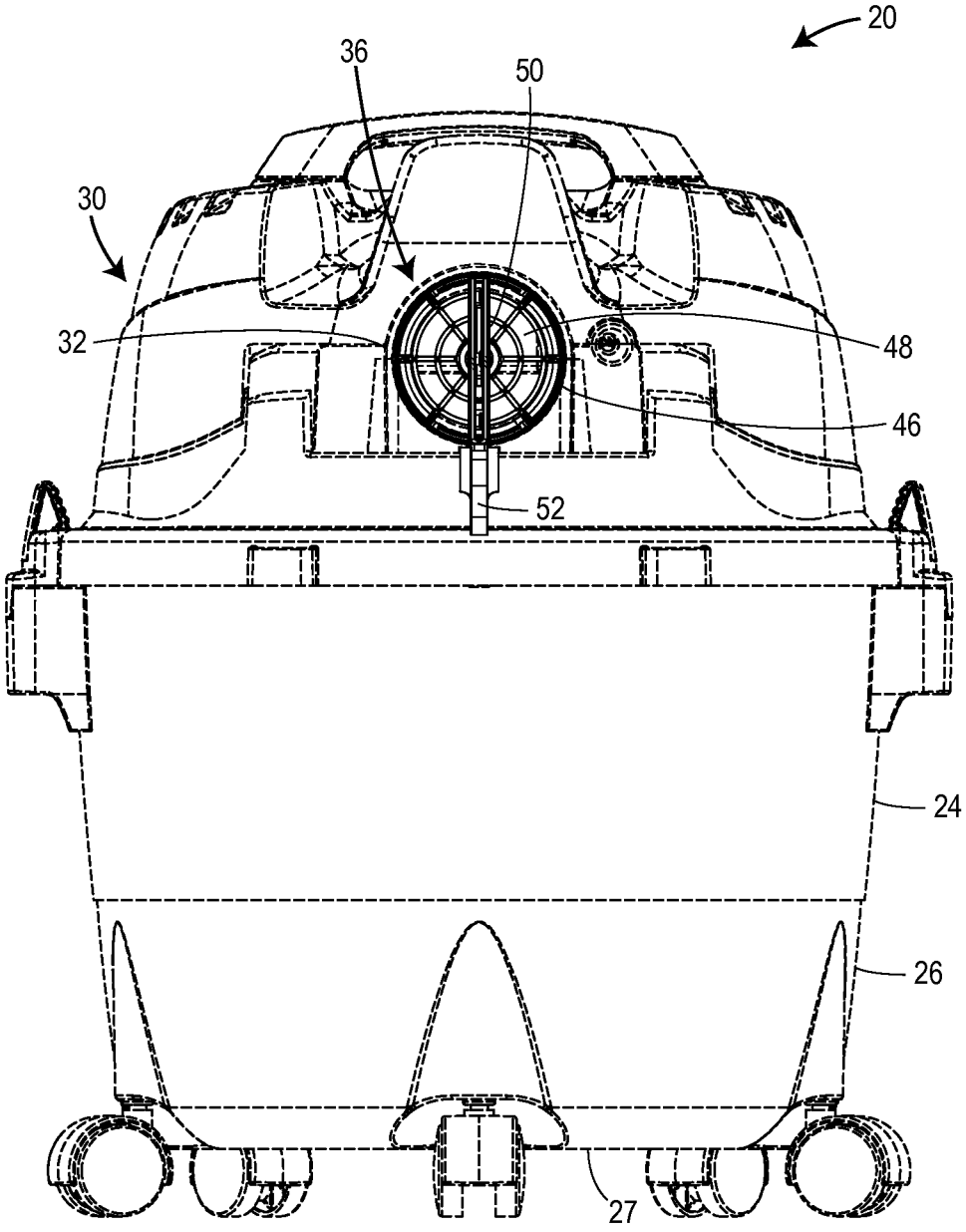
FIG. 4 is rear view of the vacuum cleaner with the airflow indicator assembly of the present disclosure.

As illustrated in FIGS. 3 and 4, the airflow indicator assembly 36 is disposed at the outlet 32. The airflow indicator assembly 36 is attached to a cap 44, which in this instance is a cylindrical body having a front end 46 with at least one aperture 48 and a rear end 47. The rear end 47 may include internal threads (not shown) that engage corresponding threads disposed on an internal surface of the outlet 32 (not shown) to removably secure the cap 44 and airflow indicator assembly 36 to the vacuum 20. The rear end 47 of the cap 44 may be alternatively press fit or snapped into the outlet 32 to secure the cap 44 and the airflow indicator assembly 36 attached thereto to the vacuum cleaner 20, and different shapes may be used for the cap 44 depending on the shape of the outlet 32. A pair of fins 50 is attached to a spine 49 (FIG. 6), which is connected to the front end 46 of the cap 44, as explained in more detail below. A strap 52 extending from the spine 49 is removably attached to a portion of the lid assembly 30 or the upper portion 25 of the sidewall 24 of the tank 22, as also explained in more detail below. The strap 52 secures the cap 44 and airflow indicator assembly 36 to the vacuum cleaner 20 when the cap is removed from the outlet 32, for instance, when a user wants to attach a hose to the outlet for use of the vacuum 20 as a blower.

While the airflow indicator assembly 36 is attached to the cap 44, in one example, the cap 44 and the airflow indicator assembly 36 attached thereto may form a cap assembly 69 (FIG. 5) that is adapted to be attached to the airflow outlet 32 of the vacuum cleaner 20. More specifically, threads of the cap 44 may engage internal threads on the airflow outlet 32 to attach the cap assembly 31 to the airflow outlet 32. In addition, the strap 52 may secure the cap assembly 31, which includes the cap 44 and the airflow indicator assembly 36 attached thereto in this example, to the vacuum cleaner 20 when the cap 44 is removed from the outlet 32, as explained in more detail below. In one example, the cap 44 comprises a cylindrical body. However, as one of ordinary skill in the art will appreciate, different shapes may be used for the cap depending on the shape of the outlet 32, for example. More specifically, while depicted as cylindrical in shape, the cap 44 may alternatively be partially cylindrical or take the form of another shape, such as a semi-circle, a tapered square or a tapered rectangle and still fall within the scope of the present disclosure.

Figure 5:
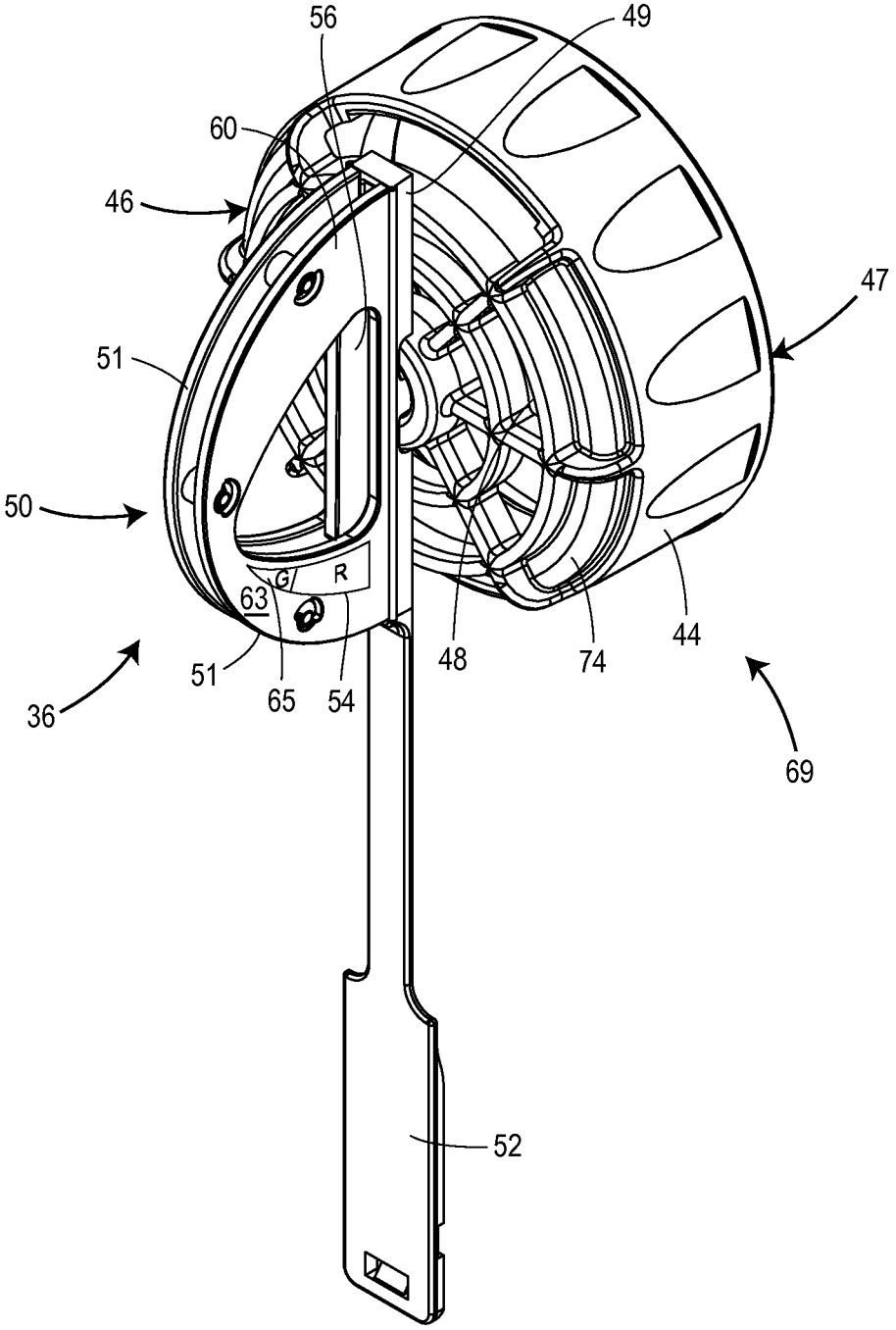
FIG. 5 is a perspective view of the airflow indicator assembly of the present disclosure attached to a cap.
Figure 6:
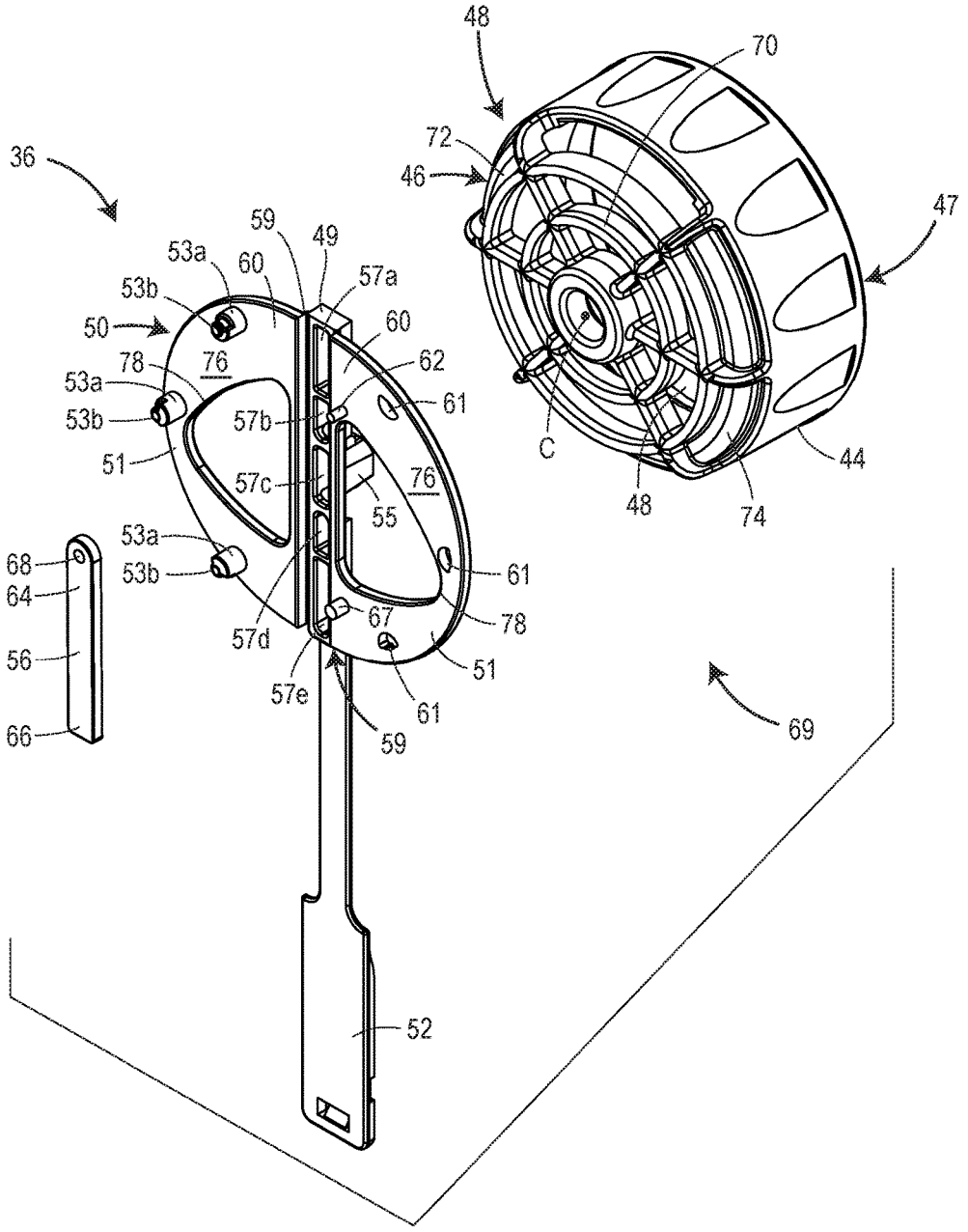
FIG. 6 is an exploded view of the airflow indicator assembly of FIG. 5.

Referring now to FIGS. 5 and 6, assembled and exploded views, respectively, of the airflow indicator assembly 36 of the present disclosure are depicted. As further illustrated therein, the airflow indicator assembly 36 may be attached, either removably or permanently to the cap 44 by a boss 55 (FIG. 6) with the front end 46 of the cap 44 having at least one aperture 48. The spine 49 is attached to the front end 46. More specifically, the boss 55 may be inserted into a center C of the front end 46 of the cap 44. The spine 49 has several apertures 57*a-e,* which permit air flowing through the apertures 48 of the cap 44 to flow through the spine 49 and thereafter contact a needle 56 to move the needle 56. The apertures 57*a-e* of the spine 49 are sized in conjunction with the width of the needle 56 so that the needle 56 will fall in the right area when there is good or poor air flow, as explained more below. For example, the width of the apertures 57*a*-57*e* is essentially the same as the width of the needle 56. At least one fin 51 of the pair of fins 50 has an outside surface 63 (FIG. 5) with a service needed area 54 (FIG. 5). The needle 56 is pivotably disposed between the pair of fins 50, such that, during operation of the vacuum cleaner 20, air is directed through the at least one aperture 48 of the cap 44, through the apertures 57*a-e* and into the pair of fins 50, pushing the needle 56 one of beyond or into the service needed area 54.

More specifically, during operation of the vacuum cleaner 20, when exhaust air or air flowing through the cap 44 is low, there is not sufficient airflow to push the needle 56 up against the force of gravity so that it is out of the service needed area 54, as depicted in FIG. 5, for example. In a similar manner, when the air flowing through the cap 44 is high, the needle 56 is pushed beyond the service needed area 54 and into a second area 65 disposed adjacent to the service needed area 54, thereby indicating service is not needed.

As illustrated in FIG. 5, the service needed area 54 may include a red area R, such that when the needle 56 points to or drops down to this area, service is needed. Alternatively, a crossed-out filter graphic (FIG. 8) or any other similar symbol may be used in the service needed area 54 to illustrate a reduced level of air is flowing through the vacuum cleaner 20. The outside surface 63 of each fin 51 may also include the second area 65 that is adjacent to the service needed area 54 and includes a green area G, such that when the needle 56 is pushed or points to this area, service is not needed. In a similar manner, instead of the green area G, a filter graphic that is not crossed-out (FIG. 8) or any other similar symbol may alternatively be used in the second area 65 adjacent to the service needed area 54 to illustrate the air is properly flowing therethrough and service is not needed. Still further, in other examples, the outside surface 63 may further include a third area disposed between the service needed area 54 and second area 55. The third area may include a yellow color Y indicating service may soon be needed.

As illustrated in FIG. 6, for example, each fin 51 of the pair of fins 50 includes a top portion 60, and the airflow indicator assembly 36 further includes a pivot axle 62 disposed between the pair of fins 50 at the top portion 60 of each fin 51 when the fins 51 are folded together. In one example, the pivot axle 62 is disposed on the fin 51 disposed right of center of the spine 49 before the fins 51 are folded together, as depicted in FIG. 6. In addition, the needle 56 includes a first end 64, a second end 66 disposed opposite the first end 64, and an aperture 68 for receiving the pivot axle 62. The needle 56 pivots upward about the pivot axle 62 with an increase in air flow through the outlet 32. An absence or a reduced level of air flow through the outlet 32, along with gravity, causes the needle 56 to drop down to a vertical position (FIG. 5) and into or point to the service needed area 54 (FIG. 5). In other words, the needle 56 pivots downward about the pivot axle 62 with a decrease in air flow through the outlet 32.

Still referring to FIG. 6, an exploded view of the airflow indicator assembly 36 is depicted, which illustrates how the airflow indicator assembly 36 is molded, for example. More specifically, the fins 51 are connected to the spine 49 by at least one hinge 59. For example, and as depicted in FIG. 6, there is one hinge 59 disposed between the spine 49 and the fin 51 that is left of the spine 49. In addition, there is another hinge 59 disposed between the spine 49 and the fin 51 that is right of the spine 49.

In addition, the fins 51 also include at least one attachment mechanism to attach the fins 51 to each other when the fins 51 are folded toward each other about the hinge 59. More specifically, and as depicted in FIG. 6, the at least one attachment mechanism includes a post 53*a* having a snap 53*b*. The post 53*a* is disposed on an inside surface of one fin 51. The at least one attachment mechanism further includes an aperture 61 that is disposed on an inside surface of the other fin 51. The aperture 61 is aligned with the post 53*a* when the fins 51 are folded together. As such, when the fins 51 are folded together about the hinge 59, the post 53*a* and snap 53*b* fit into the aperture 61, and the fins 51 are snapped together to sandwich the needle 56.

In another example, the at least one attachment mechanism may include a plurality of attachment mechanisms, such as two, three or more, which further snap and secure the fins 51 together when folded about the hinges 59. For example, and as also depicted in FIG. 6, one attachment mechanism may be disposed on a top portion, a central portion, and a bottom portion of the inside surface of each fin 51. Said another way, one fin 51 may include a post 53*a* at top, central and bottom portions of the inside surface of the fin 51 that are aligned with an aperture 55 disposed at each of the top, central and bottom portions of the inside surface of the other fin 51. Upon folding the fins 51 together about the hinge 59, each post 53*a* and snap 53*b* snaps into the corresponding aperture 55 to sandwich the needle 56. In another example, the posts 53*a* with the snaps 53*b* and apertures 55 may be melted together to make the attachment of the fins 51 to each other permanent.

In view of the foregoing, one of ordinary skill in the art will appreciate that the air indicator assembly 36 includes essentially only two molded parts. As a result, the air indicator assembly 36 is very inexpensive to make.

Figure 7:
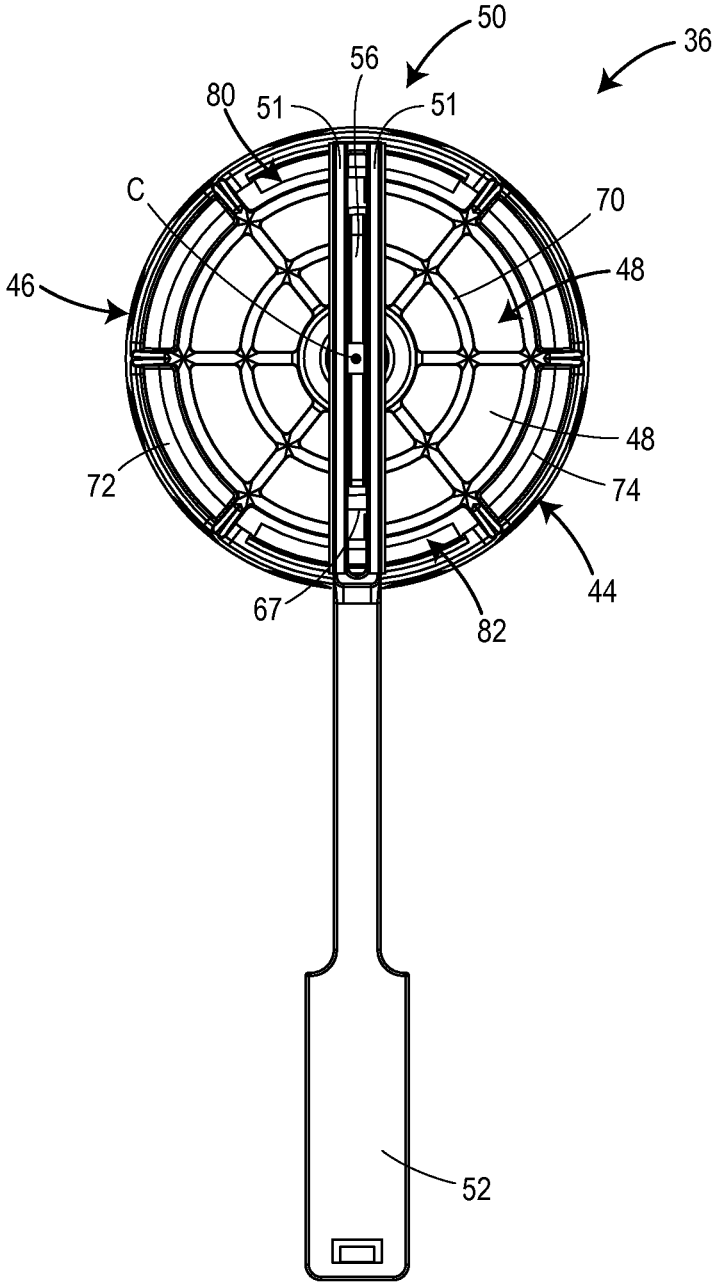
FIG. 7 is a front view of the airflow indicator assembly of the present disclosure attached to the cap.

As further illustrated in FIGS. 6 and 7, the airflow indicator assembly 36 may further include a spacer 67 disposed on a bottom portion of one of the two fins 51. In one example, the spacer 67 is disposed on the bottom portion of the fin 51 that is right of center of the spine 49. When the fins 51 are folded towards each other, the spacer 67 prevents the inside surfaces of the fins 51 from contacting each other (FIG. 7) and potentially interfering with the operation of the needle 56. While the spacer 67 is disposed on the fin 51 that is right of the spine 49 in FIG. 6, a person having ordinary skill in the art will understand that the spacer 67 may alternatively be disposed on the bottom portion of the other fin 51 that is left of the spine 49 and still fall within the scope of the present disclosure.

As further illustrated in both FIGS. 5 and 6, the front end 46 of the cap 44 of the airflow indicator assembly 36 may include not just one aperture 48, but a plurality of apertures 48. The plurality of apertures 48 allow air to flow through the cap 44 and into the pair of fins 50 disposed within a center C of front end 46 of the cap 44, such that a more accurate measurement of the actual air flow through the outlet 32 is obtained. In other words, air exiting the outlet 32 flows through the apertures 48 of the cap 44, then into the apertures 57*a-e* of the spine 49 and through a space between the fins 51, such that the fins 51 direct the air flow into the needle 56.

In addition, each fin 51 of the pair of fins 50 includes a semi-circular body 76 having a window 78 disposed within the center of the semi-circular body 76. This structure allows the needle 56 to be clearly visible through each window 78 during operation of the vacuum cleaner 20. While each fin 51 includes a semi-circular body 76, one of ordinary skill in the art will appreciate that the shape of the body 76 of each fin 51 may alternatively include an oval, a circle, a partial oval, a partial circle, a portion of a square, or a portion of a rectangle or any combination thereof and still fall within the scope of the present disclosure.

Figure 8:
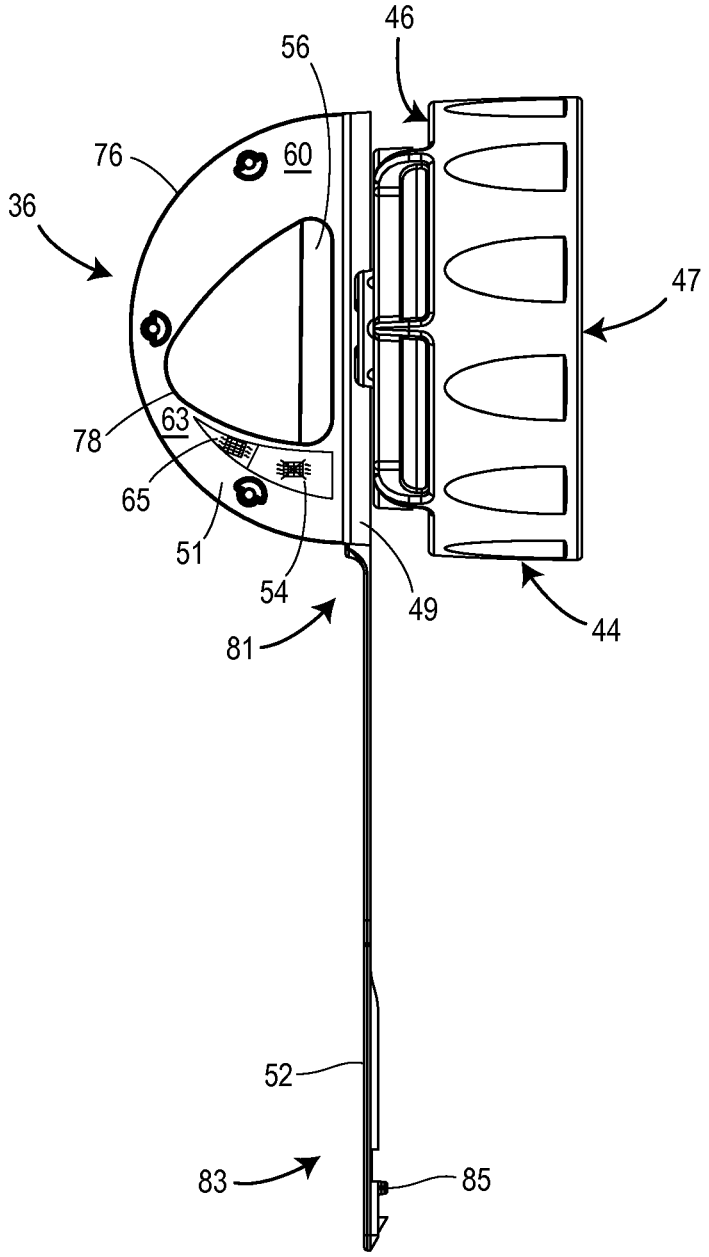
FIG. 8 is a side view of the airflow indicator assembly of the present disclosure attached to the cap.

As depicted in FIG. 8, the strap 52 extends from the spine 49 of the airflow indicator assembly 36 at a first end 81 of the strap 52. At a second end 83, the strap 52 includes a projection 85 that fits into a recess 87 (FIG. 3) on the vacuum cleaner 20, acting as a leash for the cap 44 and airflow indicator assembly 36. Said another way, the strap 52 is flexible and, thus, the projection 85 disposed on the second end 83 of the strap 52 may be moved upwardly and inserted into the recess 87 of the vacuum after the cap 44 is secured to the vacuum cleaner 20 at the outlet 32. The strap 52 secures the airflow indicator assembly 36 and the cap 44 to the vacuum 20 when the cap 44 is removed from the outlet 32, preventing both the cap 44 and the airflow indicator assembly 36 from detaching from the vacuum 20.

While various embodiments have been described herein, it is understood that the appended claims are not intended to be limited thereto, and may include variations that are still within the literal or equivalent scope of the claims.

What is claimed is:

1. A vacuum cleaner comprising:

an airflow outlet;

an airflow indicator assembly removably disposed at the outlet and including a pair of fins attached to a spine, and a needle disposed between the pair of fins;

wherein, during operation of the vacuum cleaner, exhaust air is directed through the airflow outlet towards the needle, pushing the needle thereby indicating whether service is needed.

2. The vacuum cleaner of claim 1, wherein the fins are connected to the spine by hinges and the fins include at least one attachment mechanism to attach the fins to each other when the fins are folded towards each other about the hinges.

3. The vacuum cleaner of claim 1, wherein the spine includes at least one aperture and air passes from the airflow outlet through the at least one aperture to move the needle.

4. The vacuum cleaner of claim 1, wherein, when the exhaust air flowing through the airflow outlet is low, the needle drops into a service needed area, and when the exhaust air flowing through the airflow outlet is high, the needle is pushed beyond the service needed area, indicating service is not needed.

5. The vacuum cleaner of claim 1, wherein the airflow indicator assembly further comprises a pivot axle disposed between the pair of fins, and the needle includes a first end, a second end, and an aperture for receiving the pivot axle.

6. The vacuum cleaner of claim 5, wherein the needle pivots upward about the pivot axle with an increase in air flow through the airflow outlet.

7. The vacuum cleaner of claim 1, wherein the absence of air flow through the airflow outlet causes the needle to drop down to a vertical position and into a service needed area.

8. The vacuum cleaner of claim 5, wherein the needle pivots downward about the pivot axle with a decrease in air flow through the airflow outlet.

9. The vacuum cleaner of claim 1, wherein the airflow indicator assembly is connected to a cap, the cap is connected to the airflow outlet, and the cap comprises a plurality of apertures for directing the exhaust air towards the needle.

10. The vacuum cleaner of claim 1, wherein at least one fin of the pair of fins includes a window disposed within the center of the fin, such that the needle may be visible through the window during operation.

11. An airflow indicator assembly adapted to be disposed at an airflow outlet of a vacuum cleaner, the airflow indicator assembly comprising:

a spine;

a pair of fins attached to the spine; and a needle disposed between the pair of fins;

wherein, during operation of the vacuum cleaner, exhaust air is directed through the airflow outlet and towards the needle, pushing the needle thereby indicating whether service is needed.

12. The airflow indicator assembly of claim 11, wherein the spine includes at least one aperture and air passes from the airflow outlet through the at least one aperture to move the needle.

13. The airflow indicator assembly of claim 11, wherein, when the exhaust air flowing through the airflow outlet is low, the needle drops into a service needed area, and when the exhaust air flowing through the airflow outlet is high, the needle is pushed beyond the service needed area, indicating service is not needed.

14. The airflow indicator assembly of claim 11, wherein each fin of the pair of fins further comprises a window disposed within a center of the fin, such that the needle may be visible through the window during operation.

15. The airflow indicator assembly of claim 11, wherein the airflow indicator assembly further comprises a pivot axle disposed between the pair of fins at the top portion of each fin of the pair of fins, and the needle includes a first end, a second end, and an aperture for receiving the pivot axle disposed at the first end.

16. The airflow indicator assembly of claim 11, wherein the fins are connected to the spine by hinges, and the fins include at least one attachment mechanism to attach the fins to each other when the fins are folded toward each other about the hinges.

17. The airflow indicator assembly of claim 11, further comprising a strap having a first end extending from the spine and a second end with a projection, the projection adapted to be inserted into a recess of the vacuum cleaner to secure the airflow indicator assembly to the vacuum cleaner.

18. The airflow indicator assembly of claim 16, wherein the at least one attachment mechanism comprises a post having a snap disposed on one fin of the pair of fins and a corresponding aperture disposed on the other fin of the pair of fins, such that each post fits into the corresponding aperture when the fins are folded toward each other about the hinges, snapping the fins together.

19. A cap assembly for an airflow outlet of a vacuum cleaner, the cap assembly comprising:

a cap having a front end with at least one aperture; and an airflow indicator assembly attached to the front end of the cap and including a pair of fins attached to a spine, and a needle disposed between the pair of fins;

wherein, during operation of the vacuum cleaner, exhaust air is directed through the airflow outlet towards the needle, pushing the needle indicating whether service is needed.

20. The cap assembly of claim 19, wherein the fins are connected to the spine by at least one hinge, and the fins include at least one attachment mechanism to attach the fins to each other when the fins are folded towards each other about the at least one hinge.

21. The cap assembly of claim 19, wherein the spine includes at least one aperture, and air passes from the airflow outlet through the at least one aperture of the spine to move the needle.

22. The cap assembly of claim 19, wherein, when the exhaust air flowing through the outlet is low, the needle drops into a service needed area, and when the exhaust air flowing through the outlet is high, the needle is pushed beyond the service needed area, indicating service is not needed.

23. The cap assembly of claim 19, wherein the airflow indicator assembly further comprises a pivot axle disposed between the pair of fins, and the needle includes a first end, a second end, and an aperture for receiving the pivot axle.

24. The cap assembly of claim 19, wherein the airflow indicator assembly further comprises a strap having a first end extending from the spine and a second end having a projection adapted to be received within an aperture of the vacuum cleaner to secure the cap and airflow indicator assembly to the vacuum cleaner.

25. The cap assembly of claim 19, wherein the airflow indicator assembly is attached to the cap by a boss, and the spine is attached to the front end of the cap.

26. A method of manufacturing an airflow indicator assembly comprising:

disposing a needle between a pair of fins attached to a spine;

folding each fin of the pair of fins towards each other about at least one hinge disposed between the spine and at least one fin; and attaching the fins to each other via at least one attachment mechanism.

27. The method of claim 26, wherein disposing a needle between a pair of fins comprises disposing a needle on a pivot axle disposed on one fin.

28. The method of claim 26, wherein attaching the fins to each other further comprises inserting at least one post disposed on one fin into at least one corresponding aperture disposed on the other fin when the fins are folded toward each other, snapping the fins together.

29. The method of claim 28, wherein attaching the fins to each other further comprises melting each post disposed in each corresponding aperture, permanently attaching the fins to each other.

* * * * *